United States Patent [19]

Martini et al.

[11] 4,416,795

[45] Nov. 22, 1983

[54] MIXTURES OF OPTICAL BRIGHTENERS

[75] Inventors: Thomas Martini, Kelkheim; Hans Frischkorn; Erich Schinzel, both of Hofheim am Taunus; Heinz Probst, Sulzbach, all of Fed. Rep. of Germany

[73] Assignee: Hoechst Aktiengesellschaft, Fed. Rep. of Germany

[21] Appl. No.: 346,561

[22] Filed: Feb. 8, 1982

[30] Foreign Application Priority Data

Feb. 12, 1981 [DE] Fed. Rep. of Germany ..... 3104992

[51] Int. Cl.[3] ..... C09K 11/06

[52] U.S. Cl. ..... 252/301.23; 252/301.22; 252/301.24; 252/301.28; 252/301.32

[58] Field of Search ..... 252/301.22, 301.23, 252/301.24, 301.28, 301.32, 3

[56] References Cited

U.S. PATENT DOCUMENTS

| | | | |
|---|---|---|---|
| 3,974,172 | 8/1976 | Sahm et al. | 252/301.22 X |
| 4,122,257 | 10/1978 | Prossel et al. | 252/301.24 X |
| 4,330,427 | 5/1982 | Martini et al. | 252/301.24 |
| 4,336,155 | 6/1982 | Martini et al. | 252/301.21 |

*Primary Examiner*—F. Edmundson

*Attorney, Agent, or Firm*—Connolly and Hutz

[57] ABSTRACT

Mixtures of optical brighteners composed of (a) 1 to 99% by weight of one or more compounds of the formula (1)

(1)

wherein $R_1$, $R_2$, $R_3$, $R_4$, $R_5$ and $R_6$ can be identical or different and denote hydrogen, chlorine, $C_1$–$C_4$ carbalkoxy, $C_1$–$C_4$-alkyl or $C_1$–$C_4$-alkoxy and (b) 99 to 1% by weight of one or more compounds of the formulae (2)

(3)

(4)

(5)

in which n denotes 0 or 1, $R_7$ and $R_8$ denote identical or different radicals from the group comprising hydrogen, fluorine, chlorine, phenyl, trifluoromethyl, $C_1$–$C_4$-alkyl, alkoxy, cyano, carboxyl, carboalkoxy, carboxamide or alkyl sulfonates, and two adjacent radicals $R_7$ and $R_8$ together can also represent a benzene ring, a lower alkylene group or a 1,3-dioxapropylene group, and B denotes a cyano group, a carboxylate group or a carboxamide group or a 1,2,4-oxadiazol-3-yl group, a 1,3,5-oxadiazol-2-yl group, a phenyl group or a 1,3,4-oxadiazol-2-yl group.

5 Claims, No Drawings

MIXTURES OF OPTICAL BRIGHTENERS

Optical brighteners are nowadays frequently used in the form of mixtures of various types, because such mixtures often have a synergistic effect, ie. the degree of whiteness of the mixture is higher than the degree of whiteness provided by the same amount of individual components taken on their own. For example mixtures of optical brighteners which are composed of a compound from the series of bis-benzoxazolylstyrenes and a further compound of the bis-benzoxazolylethylene structure have thus already been disclosed (Japanese Patent Specification No. 50/102,621).

It has now been found that a markedly higher increase in the degree of whiteness is obtained if bis-benzoxazolylstyrenes are mixed with a different brightener which has the structure indicated below.

The invention thus relates to mixtures of optical brighteners, composed of (a) 1 to 99% by weight of one or more compounds of the formula (1)

(1)

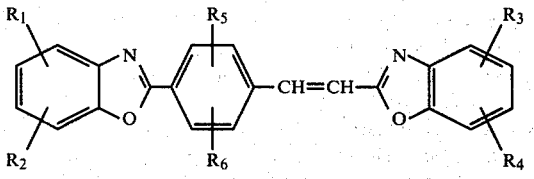

wherein $R_1$, $R_2$, $R_3$, $R_4$, $R_5$ and $R_6$ can be identical or different and denote hydrogen, chlorine, $C_1$-$C_4$-alkyl, $C_1$-$C_4$-alkoxy or $C_1$-$C_4$-carbalkoxy and (b) 99 to 1% by weight of one or more compounds of the formulae (2)

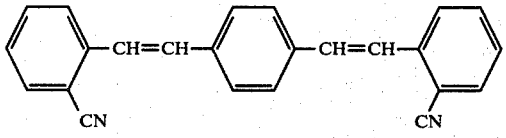

(3)

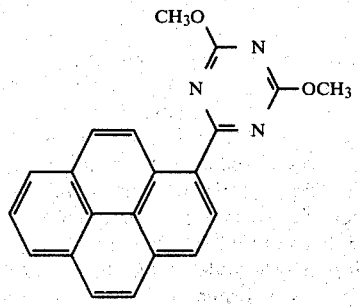

(4)

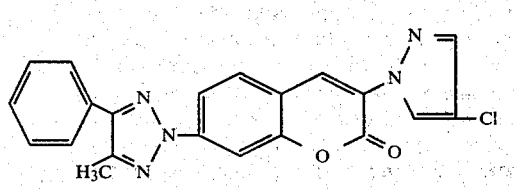

-continued (5)

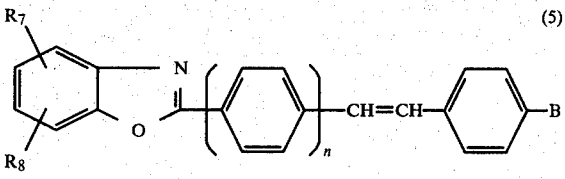

in which n denotes 0 or 1, $R_7$ and $R_8$ denote identical or different radicals from the group comprising hydrogen, fluorine, chlorine, phenyl, trifluoromethyl, $C_1$-$C_4$-alkyl, alkoxy, cyano, carboxyl, carboalkoxy, carboxamide and alkyl sulfonates, and two adjacent radicals $R_7$ and $R_8$ together can also represent a benzene ring, a lower alkylene group or a 1,3-dioxapropylene group, B denotes cyano, a group of the formula —$COOR_9$ or $CONR_9R_9$, in which $R_9$ denotes hydrogen, $C_1$-$C_{18}$-alkyl, cycloalkyl, aryl, alkylaryl, halogenoaryl, aralkyl, alkoxyalkyl, halogenoalkyl, hydroxyalkyl, carboxyalkyl or carboalkoxyalkyl, or two alkyl radicals or alkylene radicals of the meaning of $R_9$ together with the nitrogen atom can also form a morpholine, piperidine or piperazine ring, or B denotes a group of the formulae

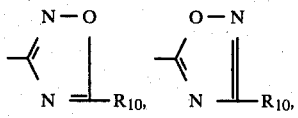

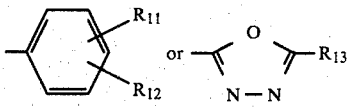

in which $R_{10}$ denotes a straight-chain or branched alkyl group having 1–18 C atoms, preferably 1–6 C atoms, which can be substituted by hydroxyl groups, halogen atoms, alkoxy radicals, aryloxy radicals or aryl radicals, or $R_{10}$ denotes a group of the formula —$(CH_2CH_2O)_n$-R with n denoting 1, 2 or 3 and R denoting H or alkyl, or $R_{10}$ denotes a radical of the formula

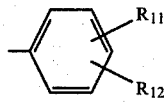

$R_{11}$ and $R_{12}$ denote identical or different radicals from the group comprising hydrogen, fluorine, phenyl, alkyl, alkoxy, acylamino, cyano, carboxyl, carboalkoxy, carboxamide and alkyl sulfonates, and two adjacent radicals $R_{11}$ and $R_{12}$ together can also represent an alkylene group, a fused-on benzene ring or a 1,3-dioxapropylene group, and $R_{13}$ denotes a phenyl ring which can be substituted by an alkyl group, a cyano group or a carbalkoxy group.

Those compounds of the formula (1) are preferred in which $R_2$, $R_4$, $R_5$ and $R_6$ represent hydrogen and $R_1$ and $R_3$ denote methyl or ethyl, in each case in the 5-position.

Among compounds of the formula (5), compounds of the formula (5a) are preferred.

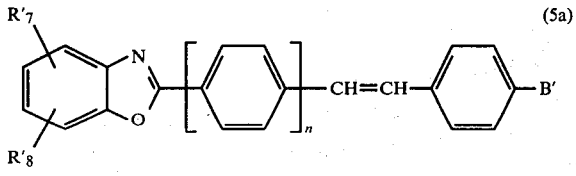

(5a)

in which $R'_7$ and $R'_8$ together denote a fused-on benzene ring or denote hydrogen, chlorine, alkyl or phenyl, n denotes 0 or 1 and B' denotes a group of the formulae

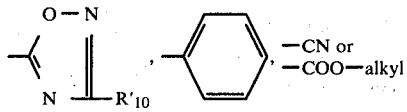

and $R'_{10}$ denotes alkyl or alkoxyalkyl.

The following compounds which are included under the formula 5 are of particular importance:

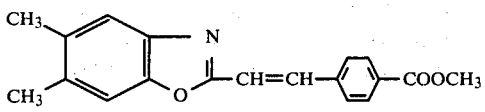

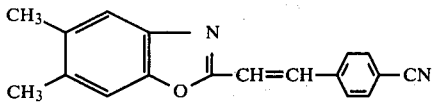

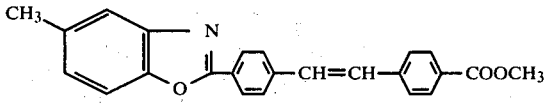

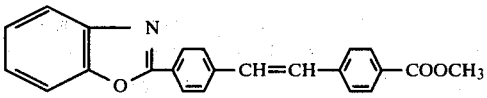

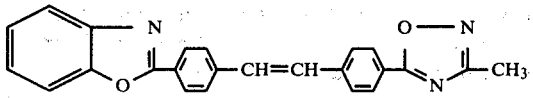

Unless otherwise defined, alkyl groups and alkoxy groups and other groups derived therefrom contain 1 to 4 C atoms.

The mixing ratio for the individual components is between 1 and 99% by weight for a compound of the formula (1) and correspondingly 99 to 1% by weight for the remaining compounds of the formulae (2) to (5). These compounds of the formulae (2) to (5) can be used singly, but also in any desired mixture with one another, the mixing ratio of these compounds with one another being quite immaterial and it being possible to vary it as desired. A mixing ratio of 50 to 99% by weight for a compound of the formula (1) and 50 to 1% by weight of compounds of the formulae (2) to (5) is preferred.

The optimum mixing ratio of all the compounds depends in a particular case on the structure of particular compounds and can readily be determined by simple prior experiments.

As is customary for optical brighteners, the individual components are brought into a commercial form by dispersing them in a liquid medium, for example water. This can be achieved by dispersing the individual components on their own and then combining the dispersions. However, it is also possible to mix the individual components with one another in bulk and to disperse them together thereafter. This dispersing step is carried out in a customary manner in ball mills, colloid mills, bead mills or dispersion kneaders. Mixtures according to the invention are particularly suitable for brightening textile material composed of linear polyesters, polyamides and acetylcellulose. However, these mixtures can also produce a satisfactory result on blend fabrics which are composed of linear polyesters and other synthetic or natural fiber substances, namely fibers containing hydroxyl groups, in particular cotton. The application of these mixtures is carried out here under conditions customary for the application of optical brighteners, thus for example by an exhaust process at 90° C. to 130° C. with or without the addition of accelerators (carriers) and bleaching agents, such as, for example, sodium chlorite or by the thermosol process. Water-insoluble brighteners and mixtures according to the invention can also be used dissolved in organic solvents, for example perchloroethylene or fluorinated hydrocarbons. This can be carried out by treating the textile material by an exhaust method with a solvent liquor which contains an optical brightener in the form of a solution, or the textile goods are impregnated, nip-padded or sprayed with the brightener-containing solvent liquor and thereafter dried at temperatures of 120°–220° C., which fixes all of the optical brightener in the fiber. This produces goods which exhibit an outstanding white effect which has an excellent light-fastness, fastness to sublimation, heat resistance and also resistance to oxidation agents and reducing agents. These mixtures produce outstanding whites even at relatively low fixing temperatures, for example at 150° C.

EXAMPLES

Fabric made from polyester staple fibers was treated at 150° C., 170° C. and 190° C. and 80% expression in a pad thermosol process and at 120° C. for 45 minutes in a high temperature exhaust process with mixtures, according to the invention, of optical brighteners. A compound of the formula

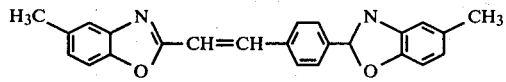

served in all cases as mixture component 1 of the general formula (1). Brighteners which were not in the form of commercially available dispersions were first dispersed by a so-called rapid finish. In this method, a clear solution was prepared of 100 mg of the brightener(s) each in 5 ml of dimethylformamide and 5 ml of an 85% strength solution of nonylphenol which had been oxyethylated with 22 to 26 units of ethylene oxide and the solution was added with stirring at a uniform rate to 90 g of ice water. The degrees of whiteness according to the Ciba-Geigy definition and the hue according to the Ganz formula were measured by means of an Elrepho tristimulus spectrophotometer on fabric samples which were treated as described below under A-D. The degrees of whiteness measured and the respective application conditions are shown in the table below. For comparison, mixtures of the brightener of the above formula and a brightener from the series of bis-benzoxazolylethylenes in accordance with the state of the art were also tested. The letters A to D in the first column of the tables identify the various application methods as follows: A denotes pad thermosol process for 60 seconds at 150° C., B denotes pad thermosol process for 40 seconds at 170° C., C denotes pad thermosol process for 30 seconds at 190° C. and D denotes exhaust process under high temperature conditions (120° C.).

| Process | Proportion of mixture component 1 | Formula and proportion of mixture component 2 | Degree of white | Hue |
|---|---|---|---|---|
| A | 30% by weight | 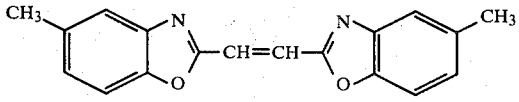 (comparison) 70% by weight | 185 | 0.1 B |
| A | 30% by weight | 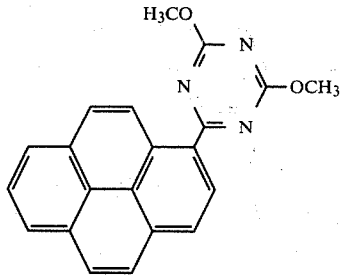 70% by weight | 220 | 0.5 R |
| A | 30% by weight | 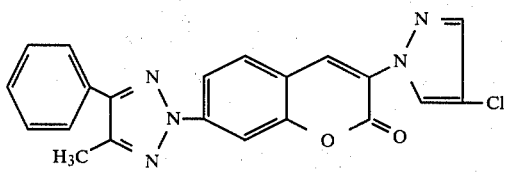 70% by weight | 196 | 0.0 B |
| B | 30% by weight | 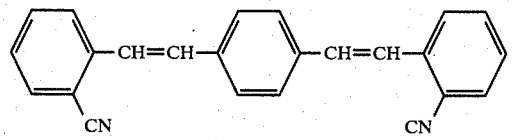 70% by weight | 202 | −0.4 B |
| A | 55% by weight | 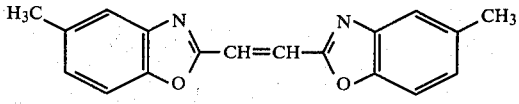 (comparison) 45% by weight | 186 | 0.3 B |
| A | 55% by weight | 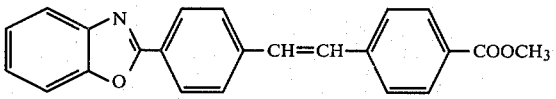 45% by weight | 191 | 0.4 G |
| A | 55% by weight | 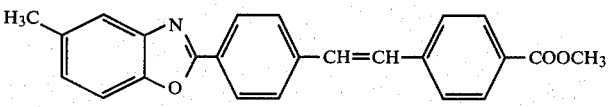 45% by weight | 192 | 0.4 G |
| A | 55% by weight | 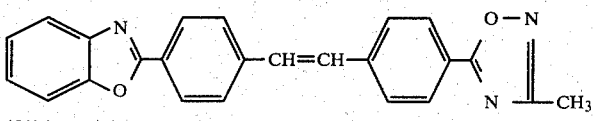 45% by weight | 197 | 0.3 B |

-continued

| Process | Proportion of mixture component 1 | Formula and proportion of mixture component 2 | Degree of white | Hue |
|---|---|---|---|---|
| A | 35% by weight | 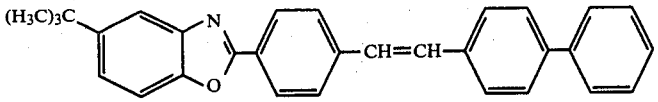 65% by weight | 193 | 1.1 G |
| A | 35% by weight | 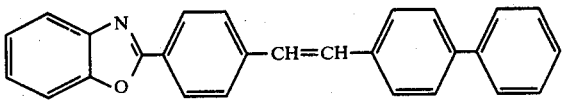 65% by weight | 192 | 1.0 G |
| A | 20% by weight | 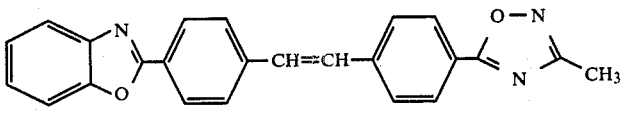 80% by weight | 195 | 0.0 B |
| B | 55% by weight | 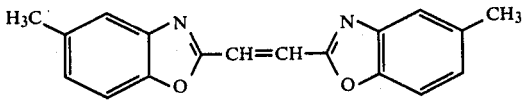 (comparison) 45% by weight | 196 | 0.1 B |
| B | 55% by weight | 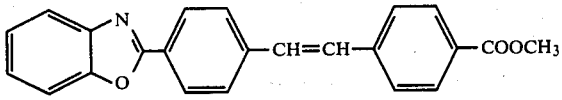 45% by weight | 202 | 0.1 B |
| B | 55% by weight | 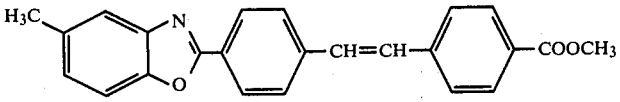 45% by weight | 204 | 0.4 B |
| B | 80% by weight | 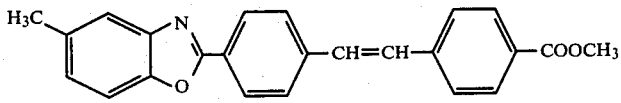 20% by weight | 201 | −0.4 B |
| B | 55% by weight | 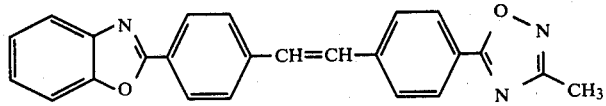 45% by weight | 208 | 0.2 B |
| B | 80% by weight | 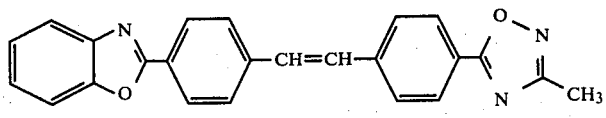 20% by weight | 211 | −0.2 B |
| C | 30% by weight | 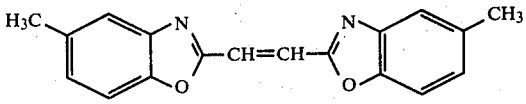 (comparison) 70% by weight | 195 | 0.1 B |
| C | 30% by weight | 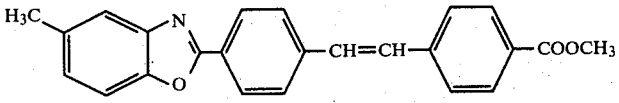 70% by weight | 204 | 0.2 B |

-continued

| Process | Proportion of mixture component 1 | Formula and proportion of mixture component 2 | Degree of white | Hue |
|---|---|---|---|---|
| C | 30% by weight | 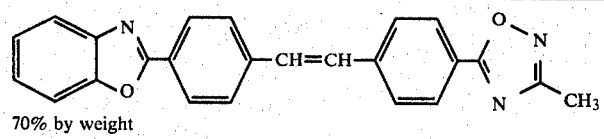 70% by weight | 208 | 0.3 B |
| D | 30% by weight | 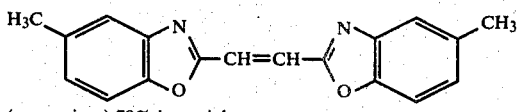 (comparison) 70% by weight | 201 | 0.1 B |
| D | 30% by weight | 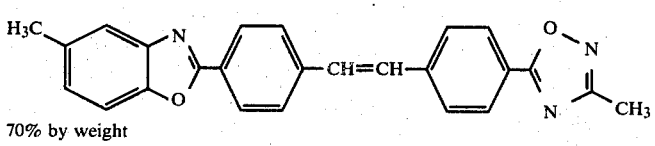 70% by weight | 210 | 0.5 G |
| D | 30% by weight | 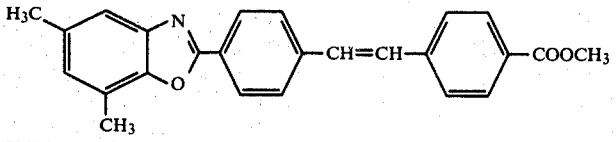 70% by weight | 206 | 0.1 B |
| D | 30% by weight | 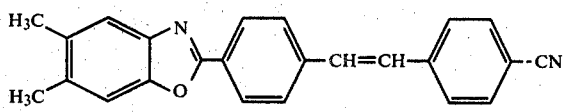 70% by weight | 210 | 0.8 G |
| D | 30% by weight | 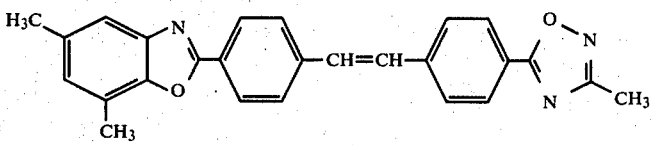 70% by weight | 211 | 1.0 G |
| D | 30% by weight | 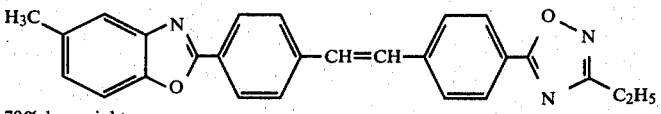 70% by weight | 209 | 0.5 G |
| D | 30% by weight | 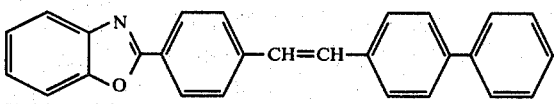 70% by weight | 214 | 0.1 B |
| D | 30% by weight | 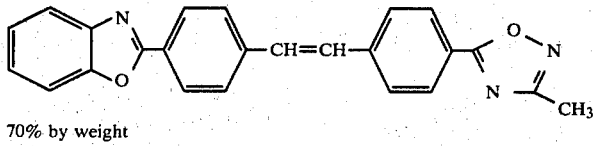 70% by weight | 212 | 0.2 B |
| D | 30% by weight | 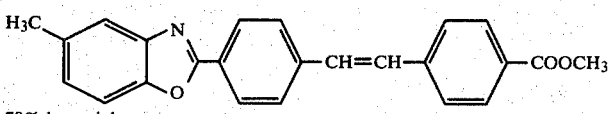 70% by weight | 211 | −0.1 B |

We claim:

1. A mixture of optical brighteners, which contains (a) 1 to 99% by weight of one or more compounds of the formula (1)

(1)

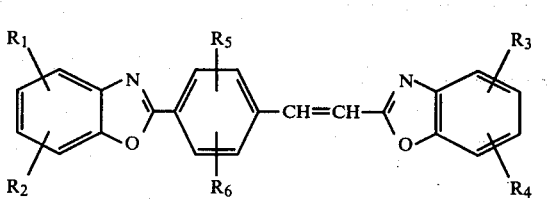

wherein $R_1$, $R_2$, $R_3$, $R_4$, $R_5$ and $R_6$ can be identical or different and denote hydrogen, chlorine, $C_1$–$C_4$-carbalkoxy, $C_1$–$C_4$-alkyl or $C_1$–$C_4$-alkoxy and (b) 99 to 1% by weight of one or more compounds of the formulae (3)

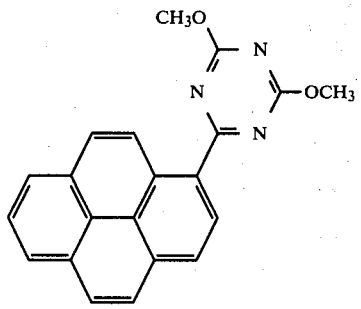

(4)

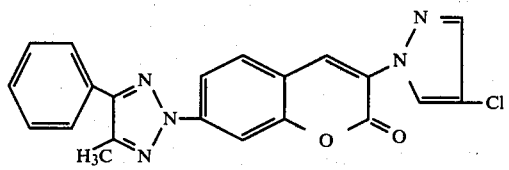

(5)

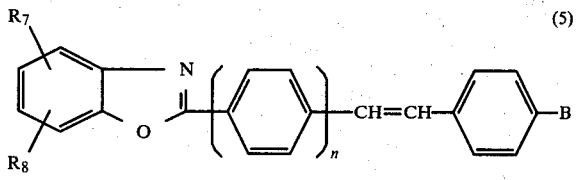

in which n denotes 0 or 1, $R_7$ and $R_8$ denote identical or different radicals from the group comprising hydrogen, fluorine, chlorine, phenyl, trifluoromethyl, $C_1$–$C_4$-alkyl, alkoxy, cyano, carboxyl, carboalkoxy, carboxamide and alkyl sulfonates, and two adjacent radicals $R_7$ and $R_8$ together can also represent a benzene ring, a lower alkylene group or a 1,3-dioxapropylene group, B denotes cyano, a group of the formula —$COOR_9$ or $CONR_9R_9$, in which $R_9$ denotes hydrogen, $C_1$–$C_{18}$-alkyl, cycloalkyl, aryl, alkylaryl, halogenoaryl, aralkyl, alkoxyalkyl, halogenoalkyl, hydroxyalkyl, carboxyalkyl or carboalkoxyalkyl, or two alkyl radicals or alkylene radicals of the meaning of $R_9$ together with the nitrogen atom can also form a morpholine, piperidine or piperazine ring, or B denotes a group of the formulae

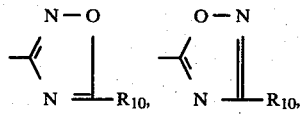

-continued

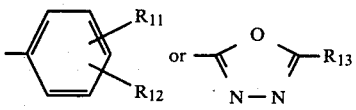

in which $R_{10}$ denotes a straight-chain or branched alkyl group having 1–18 C atoms, preferably 1–6 C atoms, which can be substituted by hydroxyl groups, halogen atoms, alkoxy radicals, aryloxy radicals or aryl radicals, or $R_{10}$ denotes a group of the formula —$(CH_2CH_2O)_n$-R with n denoting 1, 2 or 3 and R denoting H or alkyl, or $R_{10}$ denotes a radical of the formula

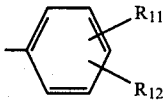

$R_{11}$ and $R_{12}$ denote identical or different radicals from the group comprising hydrogen, fluorine, phenyl, alkyl, alkoxy, acylamino, cyano, carboxyl, carboalkoxy, carboxamide and alkyl sulfonates, and two adjacent radicals $R_{11}$ and $R_{12}$ together can also represent an alkylene group, a fused-on benzene ring or a 1,3-dioxapropylene group, and $R_{13}$ denotes a phenyl ring which can be substituted by an alkyl group, a cyano group or a carbalkoxy group.

2. A mixture of optical brighteners, as claimed in claim 1, which contains a compound of the formula (1), in which $R_2$, $R_4$, $R_5$ and $R_6$ represent hydrogen and $R_1$ and $R_3$ denote methyl or ethyl in each case in the 5-position.

3. A mixture of optical brighteners, as claimed in claim 1, which contains, as a compound of the formula 5, a compound of the formula (5a)

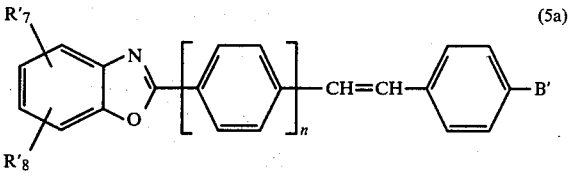

in which $R'_7$ and $R'_8$ together denote a fused-on benzene ring or denote hydrogen, chlorine, alkyl or phenyl, n denotes 1 or 2 and B' denotes a group of the formulae

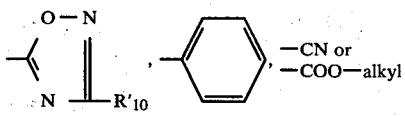

and $R'_{10}$ denotes alkyl or alkoxyalkyl.

4. A mixture of optical brighteners, as claimed in claim 1, which contains, as a compound of the formula (5), a compound of the formulae

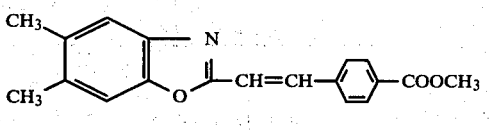

-continued
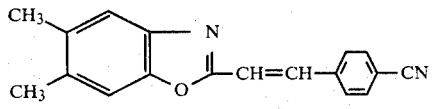
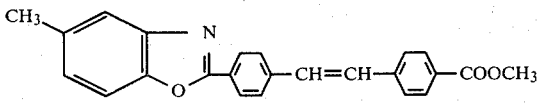
-continued
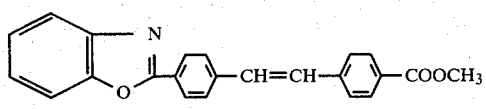
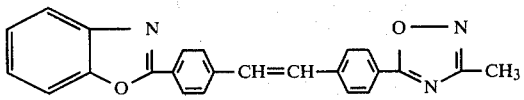
5. A mixture of optical brighteners, as claimed in claim 1, which contains 50 to 99% by weight of a compound of the formula 1 and 50 to 1% by weight of a compound of the formulae 3 to 5.
* * * * *